US010829266B2

(12) United States Patent
Zeiler

(10) Patent No.: US 10,829,266 B2
(45) Date of Patent: Nov. 10, 2020

(54) FOLDABLE CLAMSHELL CARTON

(71) Applicant: Huhtamaki, Inc., De Soto, KS (US)

(72) Inventor: George Zeiler, Olathe, KS (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 16/529,391

(22) Filed: Aug. 1, 2019

(65) Prior Publication Data

US 2020/0039682 A1 Feb. 6, 2020

Related U.S. Application Data

(60) Provisional application No. 62/713,266, filed on Aug. 1, 2018.

(51) Int. Cl.

| | |
|---|---|
| ***B65D 5/66*** | (2006.01) |
| ***B65D 5/06*** | (2006.01) |
| ***B65D 5/42*** | (2006.01) |
| ***B65D 5/36*** | (2006.01) |

(52) U.S. Cl.

CPC ..... *B65D 5/667* (2013.01); *B65D 5/061* (2013.01); *B65D 5/3621* (2013.01); *B65D 5/4266* (2013.01); *B65D 2543/00018* (2013.01)

(58) Field of Classification Search

CPC ..... B65D 5/667; B65D 5/061; B65D 5/3621; B65D 5/4266; B65D 5/0085; B65D 5/2057; B31B 2100/0024; A47G 21/001

USPC ..... 229/114, 146, 906, 145, 902, 164; 206/518; D9/423

See application file for complete search history.

(56) References Cited

U.S. PATENT DOCUMENTS

| | | | | |
|---|---|---|---|---|
| 1,271,033 | A | 7/1918 | Hall | |
| 1,463,448 | A | 7/1923 | Stern | |
| 2,008,935 | A | 7/1935 | Stern et al. | |
| 2,177,993 | A | 10/1939 | Olsen | |
| 2,605,955 | A | 8/1952 | Meller | |
| 2,889,102 | A | 6/1959 | Wagaman | |
| 3,069,061 | A | 12/1962 | Dion | |
| 3,450,330 | A | 6/1969 | Pierce, Jr. | |
| 3,481,525 | A | 12/1969 | Pierce, Jr. | |
| 3,734,391 | A | 5/1973 | Manizza | |
| 4,022,372 | A | 5/1977 | Graser | |
| 4,105,155 | A | 8/1978 | Forbes, Jr. | |
| 4,232,816 | A * | 11/1980 | Johnson | B65D 5/2047 229/114 |
| 4,362,266 | A | 12/1982 | Webinger | |

(Continued)

*Primary Examiner* — Christopher R Demeree

(74) *Attorney, Agent, or Firm* — Husch Blackwell LLP

(57) ABSTRACT

A foldable clamshell container is provided. The container may include a tray portion and a cover portion. The tray portion may include a front panel, rear panel, and side panels. The side panels may include triangular fold flaps on each end that are secured end flaps connected to the front and rear panels. The rear panel may have a height greater than the front and side panels and the cover portion may be foldably connected to an upper edge of the rear panel. The cover panel may include a cover panel, a front panel, and cover side panels with a triangular fold flap. The rear end flaps of the tray portion and the cover side panels may each include a curved edge portion. The container may be configured to transition between a folded-flattened configuration and an unfolded configuration by folding the triangular fold flaps of the tray and cover portions.

12 Claims, 10 Drawing Sheets

(56) References Cited

U.S. PATENT DOCUMENTS

| | | | | |
|---|---|---|---|---|
| 4,431,128 | A | 2/1984 | Dirico | |
| 4,472,896 | A | 9/1984 | Brauner et al. | |
| 4,498,585 | A | 2/1985 | Gordon et al. | |
| 4,570,845 | A | 2/1986 | Hall | |
| 4,877,178 | A | 10/1989 | Eisman | |
| 4,951,865 | A | 8/1990 | Eisman | |
| 5,117,973 | A | 6/1992 | Lo Duca | |
| 5,205,476 | A | 4/1993 | Sorenson | |
| 5,221,040 | A | 6/1993 | Sorenson | |
| 5,332,147 | A | 7/1994 | Sorenson | |
| 5,377,903 | A | 1/1995 | Gordon et al. | |
| 5,388,758 | A * | 2/1995 | Scovell | B65D 5/4266 229/114 |
| 5,431,333 | A | 7/1995 | Lorenz | |
| 5,553,772 | A | 9/1996 | Jensen | |
| 5,788,145 | A | 8/1998 | Grahahm et al. | |
| 5,921,466 | A | 7/1999 | Speese et al. | |
| 6,041,997 | A | 3/2000 | Jensen | |
| 6,116,498 | A | 9/2000 | Sheffer | |
| 6,196,448 | B1 | 3/2001 | Correll | |
| 6,505,769 | B2 | 1/2003 | Stone | |
| 7,263,869 | B2 | 9/2007 | Durney et al. | |
| 8,733,622 | B2 | 5/2014 | Learn | |
| 9,278,774 | B2 | 3/2016 | Fairchild, Jr. | |
| 9,540,135 | B2 | 1/2017 | Robertson | |
| 2007/0108262 | A1 | 5/2007 | D'Amato | |
| 2008/0110966 | A1 | 5/2008 | Yocum | |
| 2010/0178396 | A1 | 7/2010 | Lafferty et al. | |
| 2011/0315753 | A1 | 12/2011 | Learn | |
| 2012/0000972 | A1 * | 1/2012 | Learn | B65D 5/667 229/112 |

* cited by examiner

FOLDABLE CLAMSHELL CARTON

CROSS-REFERENCE TO RELATED APPLICATIONS

This application claims priority to U.S. Provisional Patent Application Ser. No. 62/713,266, filed on Aug. 1, 2018, to George Zeiler, entitled "Foldable Clamshell Carton," the entire disclosure of which is incorporated herein by reference.

BACKGROUND OF THE INVENTION

Paperboard containers are commonly used in the quick-service food industry as well as various other industries as vessels for holding, transporting and storing food and other items. Such containers are commonly constructed from a flat blank and folded into a clamshell container having a tray portion and a cover portion. One problem with known containers is that once they are folded into shape and the sidewall flaps are glued or otherwise connected together to form the sidewalls of the tray portion and the cover portion, the containers are difficult to stack and nest together and/or require a significant amount wasted space during transport and storage. This is a result of the shape and configuration of the containers, which have formed sidewalls for both the tray portion and the cover portion. As a result, many quick-service food providers must utilize a significant amount of space for storage of the containers or leave the container blanks in their unformed state until ready for use and must spend time constructing the containers from the blanks.

Various other foldable paperboard containers are also often used in quick-service food industry. However, one problem with known foldable containers is that due to their foldable/collapsible construction, the container sidewalls are weakened along fold lines and can fail to maintain their upright configuration after unfolding and being formed into a container. As a result, food and other items can easily fall out of the containers, the sidewall can inadvertently collapse, and the containers can be easily deformed and difficult to hold and carry.

Accordingly, a need exists for a foldable container that can be formed from a unitary blank and easily and compactly stacked together with other similar containers after formation. Additionally, a need exists for a foldable container that can be configured from a folded state and maintain sufficient form and rigidity after formation.

BRIEF SUMMARY OF THE INVENTION

The present invention is directed to a clamshell-style carton or container configured for holding food stuffs or other suitable items. The container can include a tray portion and a cover portion foldably connected to the tray portion. The container can be transitioned between a closed position where the cover portion overlies the tray portion, and an opened position where the cover portion is rotated away from the tray portion.

The tray portion of the container can include a bottom panel, opposing front and rear panels foldably connected to opposing edges of the bottom panel, and opposing side panels foldably connected to the remaining edges of the bottom panel. The tray portion can further include front and rear end flaps foldably connected to the lateral side edges of the front and rear panels, respectively. The front and rear end flaps can be connected to triangular fold flaps formed into the ends of the side panels in order to form an enclosed perimeter sidewall of the tray portion of the container.

The cover portion of the container can include a cover panel foldably connected to an upper edge of the rear panel of the tray portion, a front cover panel foldably connected to the opposing edge of the cover panel, and opposing cover side panels foldably connected to the remaining edges of the cover panel. The cover portion can further include front cover panel end flaps foldably connected to the later side edges of the front cover panel. The front cover panel end flaps can be connected to triangular fold flaps formed into the adjacent ends of the cover side panels in order to form a perimeter sidewall around the front and sides of the cover panel.

The container can be configured into the folded and flattened position by folding the side panels of the tray portion inward to overlie and be generally parallel to the bottom panel. As the side panels are folded inward, the triangular fold flap portions of the side panels that are connected to the front and rear end flaps can fold outward an overlie the remainder of the side panels. This can enable the front and rear panels of the tray portion to fold inward and overlie side panels and bottom panel of the tray portion to configure the tray portion into a fully folded and flattened configuration. The same procedure can be applied to the panels of the cover portion, where the cover side panels are folded inward, the triangular fold flaps are folded over and outward, and the front cover panel is folded inward to overlie the cover side panels and cover panel of the cover portion in order to configure the cover portion into a fully folded and flattened configuration. Once the tray portion and the cover portion have been fully folded, the container may be positioned into a folded and flattened position where the rear panel and the cover portion of the container are folded against and overlie the remainder of the tray portion of the container.

To unfold the container into a use position, the side panels of the tray portion can be lifted upward to cause the triangular fold flaps and front and rear end flaps to unfold and position the front and rear panels and side panels into a generally perpendicular configuration with respect to the bottom panel. The cover side panels can also be lifted upward relative to the cover panel in order to position the cover front panel and cover side panels into a generally perpendicular configuration with respect to the cover panel.

According to one embodiment, the front and rear end flaps of the tray portion, and the front end flaps of the cover portion, can include a lower terminal edge with a slightly outward angled orientation that can assist in creating a frictional, interfering, and/or engaging fit with the bottom panel and cover panel. This arrangement can assist the front, rear and side panels of the tray portion and cover portion to remain in an upright orientation when the container is unfolded into the use position.

According to one embodiment, the rear panel of the tray portion can include a height that is greater than the heights of the front panel and side panels of the tray portion. This configuration can enable the cover panel of the cover portion to be foldably connected directly to the upper edge of the rear panel, which can increase the overall structural rigidity of the container and facilitate the folding of the container into the fully folded and flattened position.

According to one embodiment, the rear end flaps of the tray portion can include an outer terminal edge with a curved profile portion and the cover side panels can include an outer terminal edge with a corresponding curved profile portion. The curvature of the curved profile portions may generally correspond to one another so that when the cover portion is folded over the tray portion to enclose the container, the curved profile portions provide a fully enclosed perimeter sidewall around the container. The curved profile portions may also provide additional structural rigidity to the container when transitioning between the open and closed positions.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
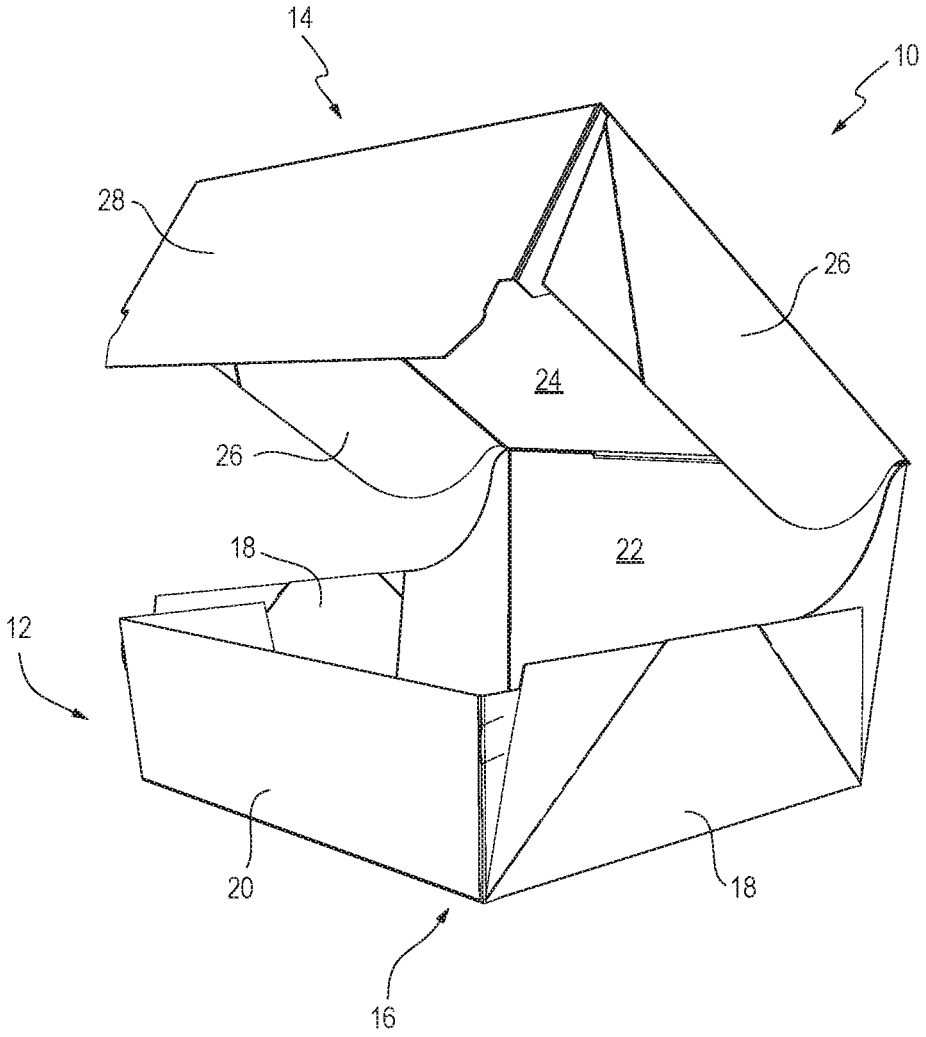
FIG. 1 is a perspective view of a foldable container in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 3:
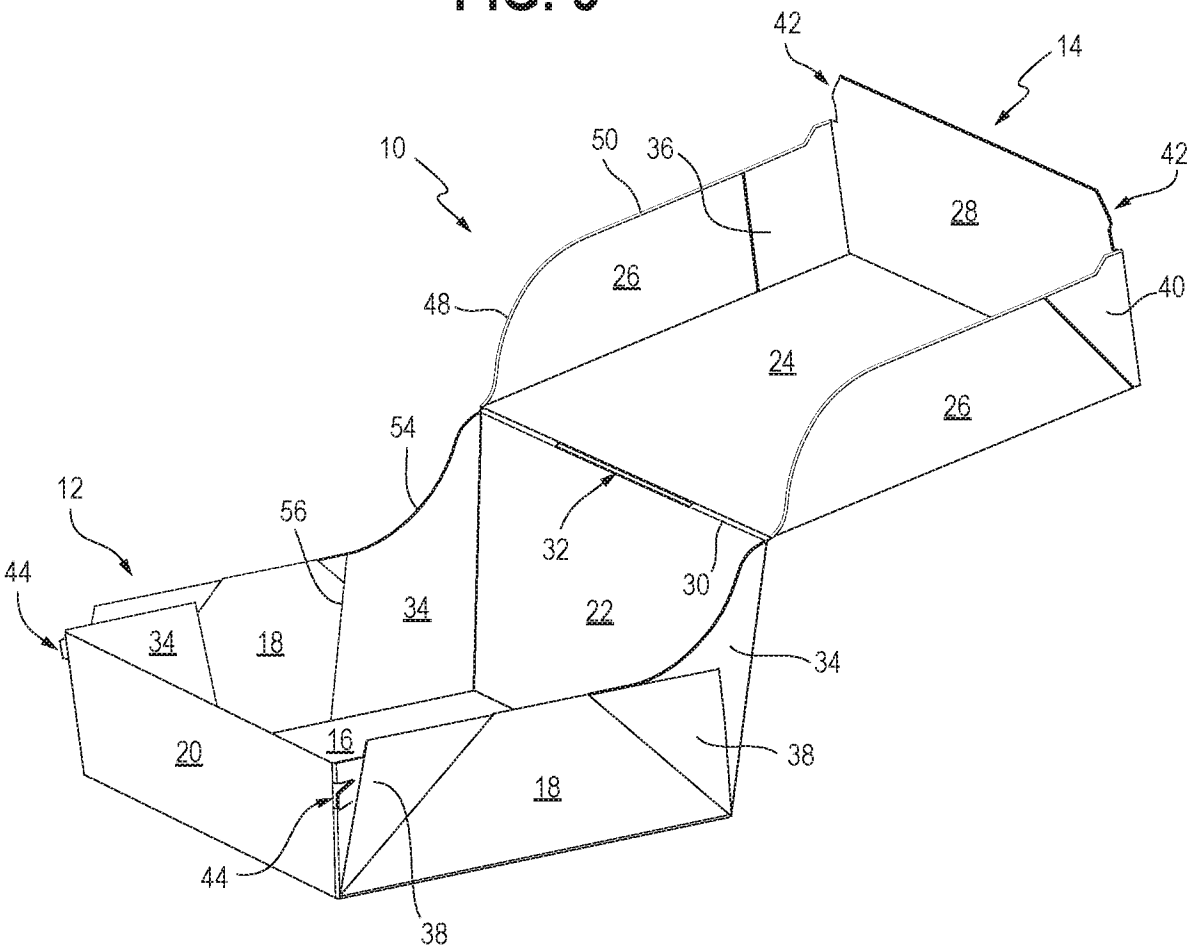
FIG. 3 is a perspective view of the foldable container of FIG. 1, illustrating the foldable container in an open-configured position in accordance with one embodiment of the present invention.
Figure 4:
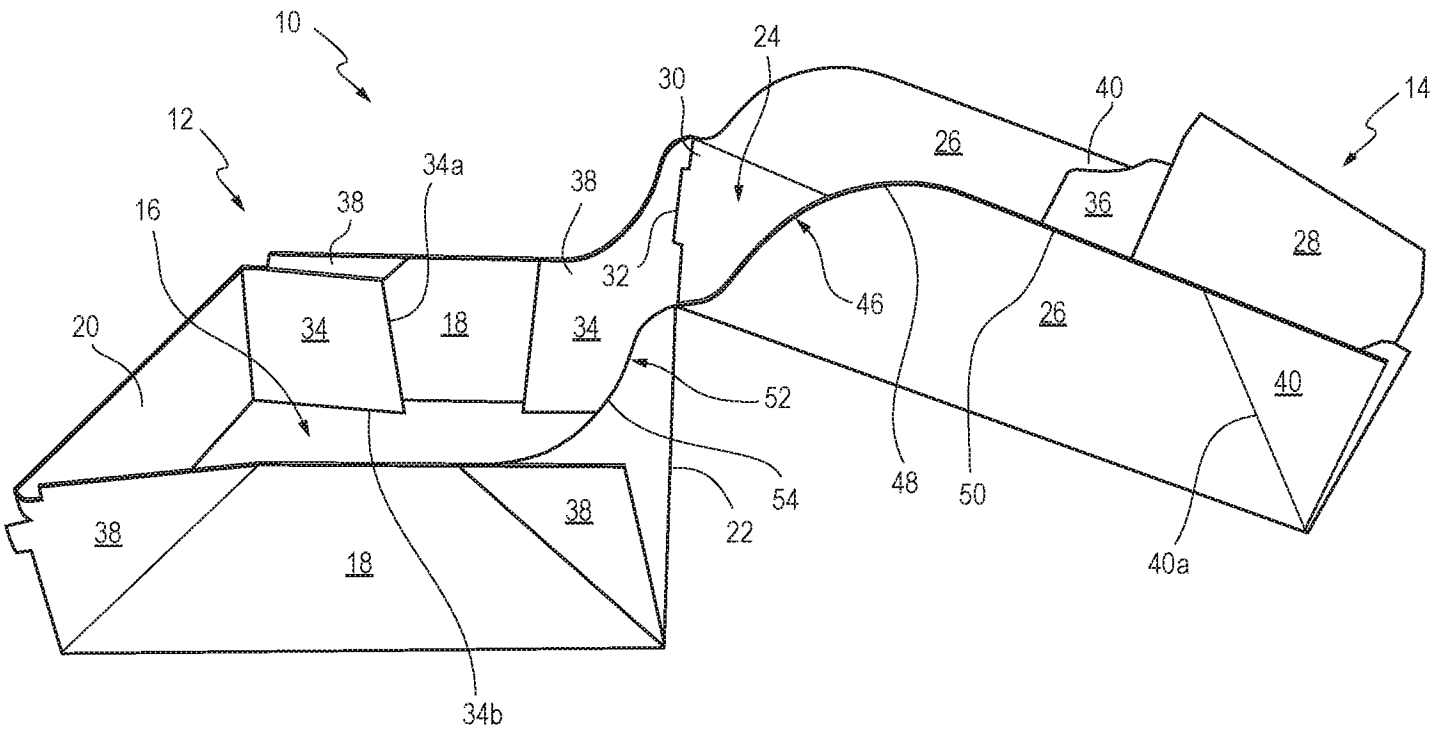
FIG. 4 is a side perspective view of the foldable container of FIG. 1, illustrating the foldable container in an open-configured position in accordance with one embodiment of the present invention.
Figure 5:
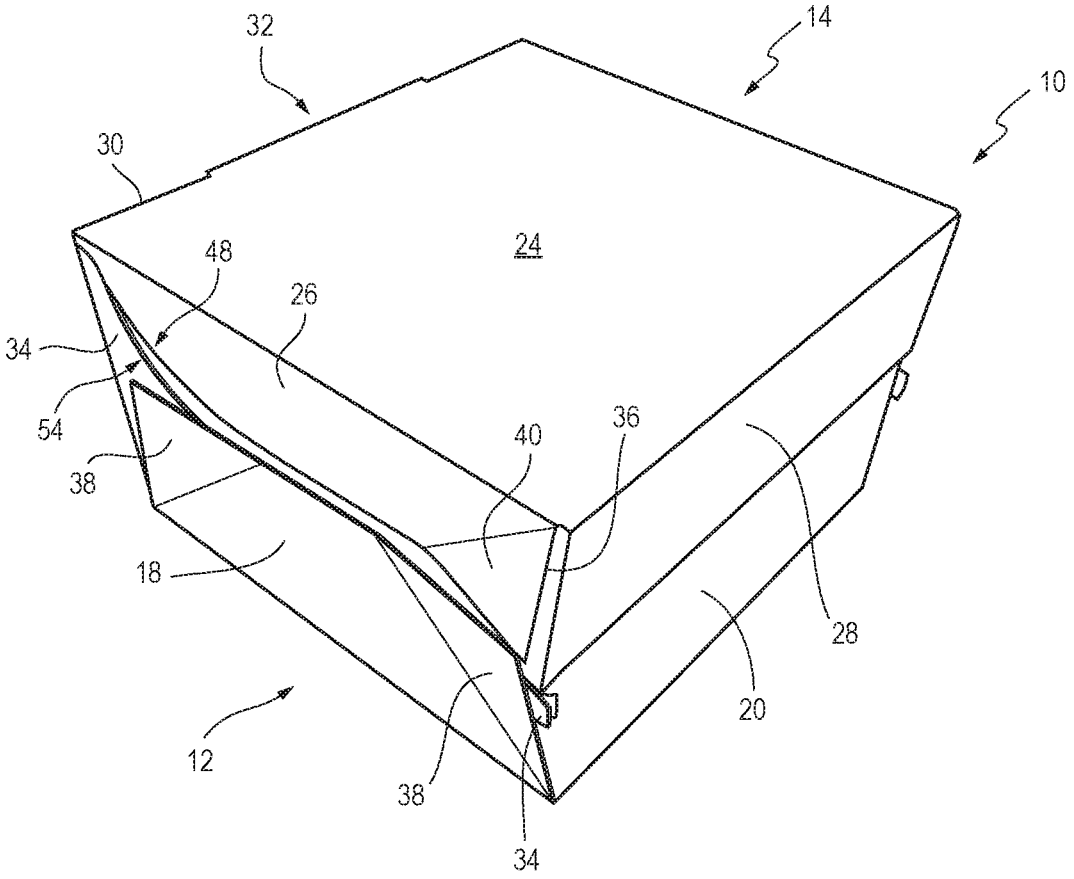
FIG. 5 is a perspective view of the foldable container of FIG. 1, illustrating the foldable container in a closed-configured position in accordance with one embodiment of the present invention.
Figure 6:
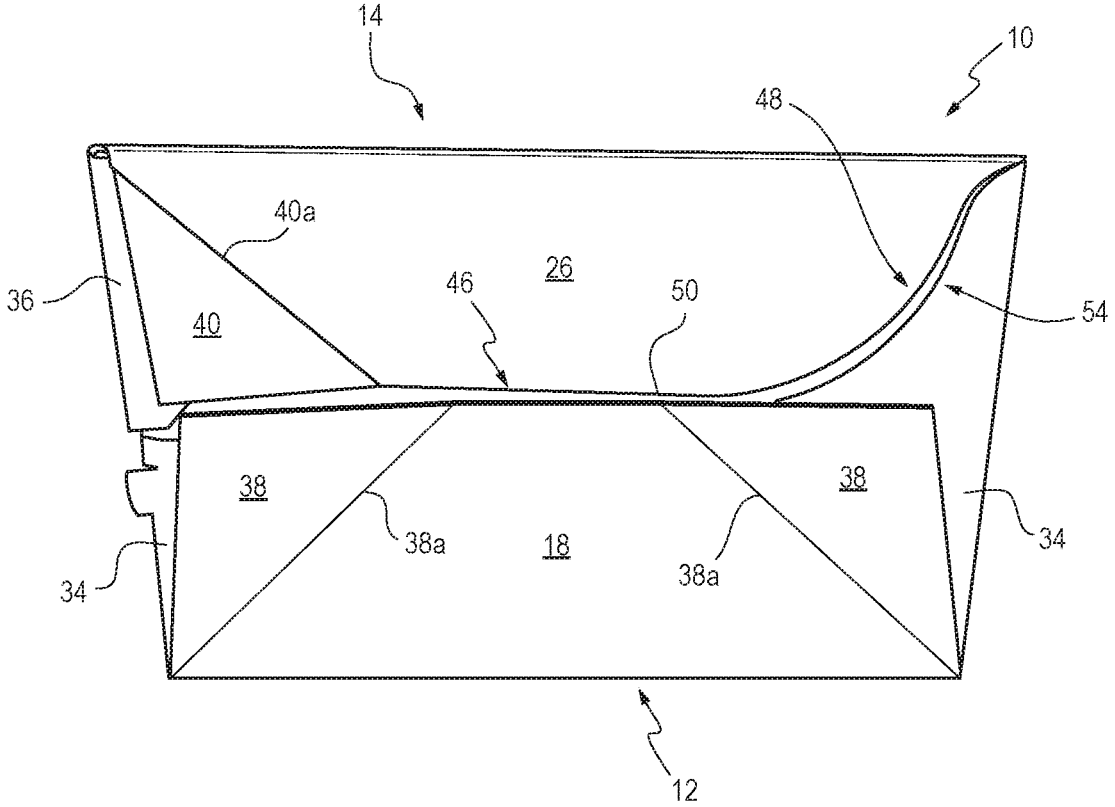
FIG. 6 is a side perspective view of the foldable container of FIG. 1, illustrating the foldable container in a closed-configured position in accordance with one embodiment of the present invention.
Figure 7:
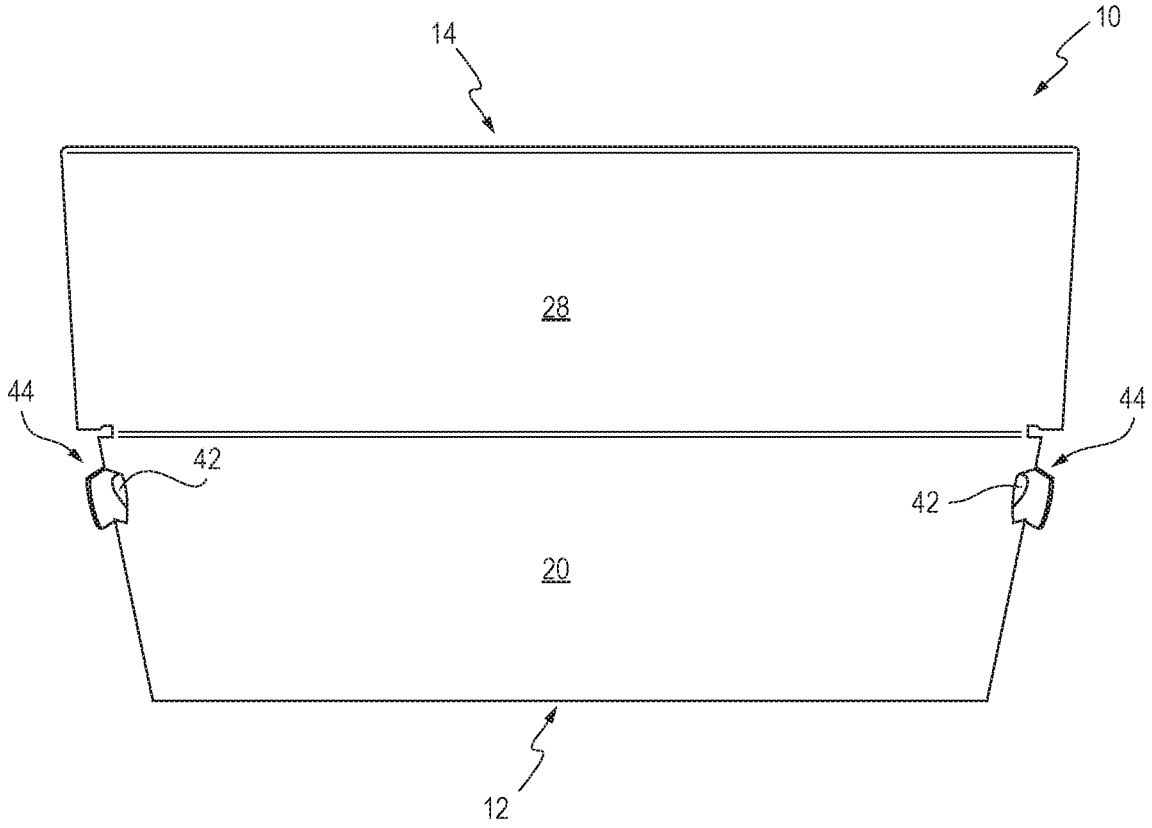
FIG. 7 is a front perspective view of the foldable container of FIG. 1, illustrating the foldable container in a closed-configured position in accordance with one embodiment of the present invention.

Referring to several figures, the present invention is directed toward a carton or container 10 capable of holding food stuffs and the like. Container 10 of the present invention may also be suitable for holding, storing and/or transporting any number of other products, materials or items depending on the particular desired use of container 10. As best shown in FIG. 1, container 10 may be configured as a clamshell-style carton that includes a tray portion 12 and a cover portion 14. As described herein and illustrated through the several figures, cover portion 14 may be configured to be selectively moveable to transition container 10 between an open position and a closed position. FIG. 1 illustrates container 10 in a partially open position and FIGS. 3-4 illustrate container 10 in a fully open position where cover portion 14 is opened and rotated away from tray portion 12. FIGS. 5-7 illustrate container 10 in the closed position where cover portion 14 is positioned over tray portion 12 to form a generally enclosed perimeter sidewalls around the interior of container 10. Container 10 can be further be configured as a foldable-flattened clamshell carton where container 10 can be constructed from a blank 100 (see FIG. 2), placed into a folded and flattened position for transport and storage (see FIGS. 8 and 9) and then placed into a use position where it is unfolded into the clamshell-style carton when ready for use (see FIGS. 3-7).

Figure 2:
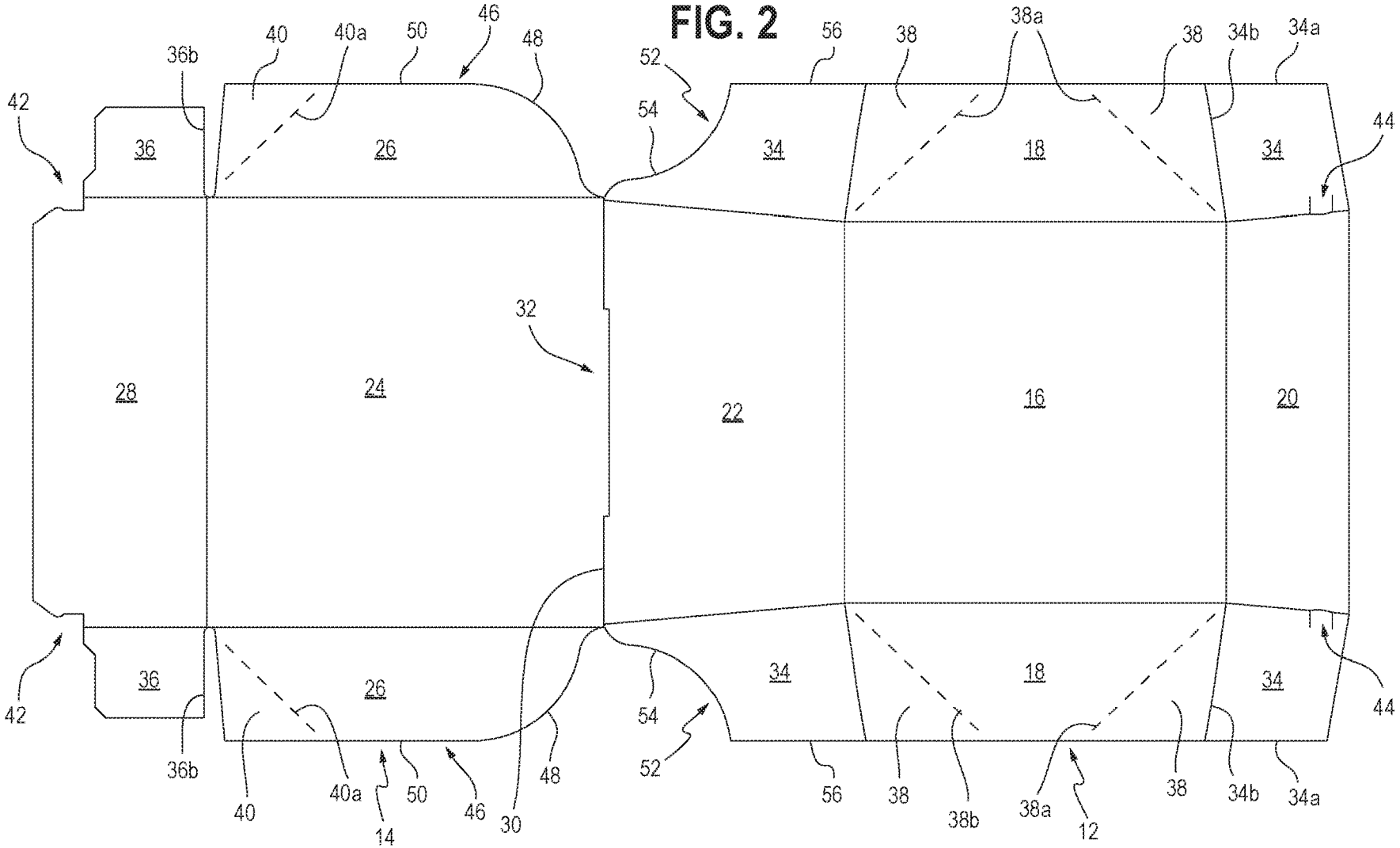
FIG. 2 is a plan view of a blank for a foldable container in accordance with one embodiment of the present invention.

Turning to FIG. 2, a blank 100 that may be used to construct container 10 is illustrated according to one embodiment of the present invention. As shown in FIG. 2 (and FIG. 1), container 10 can include a tray portion 12 and a cover portion 14, each formed from a plurality of foldable panels. As best shown in FIG. 2, tray portion 12 can include a bottom panel 16, two side panels 18, a front panel 20 and a rear panel 22. Side panels 18 can be foldably connected along fold lines to the side edges of bottom panel 16 and front and rear panels 20 and 22 can be foldably connected by fold lines to the front and rear edges, respectively, of bottom panel 16. Each of panels 18-22 can be folded away from bottom panel 16 along the corresponding fold line to form tray portion 12 as best shown in FIG. 1.

As further shown in FIG. 2, cover portion 14 can include a top panel 24, two side panels 26 and a front panel 28. Side panels 26 can be foldably connected by fold lines to the side edges of top panel 24 and front panel 28 can be foldably connected by fold lines to the front edge of top panel 24. Each of panels 26-28 can be folded away from top panel 24 along the corresponding fold line in order to form cover portion 14 as also best shown in FIG. 1.

As shown in FIGS. 1 and 2, cover portion 14 can be foldably connected to the upper edge of rear panel 22 (of tray portion 12) by a fold line 30 to provide a hinge for moving cover portion 14 between the open and closed positions relative to tray portion 12. As best shown in FIG. 2, along fold line 30 can be a slot, slit or cut 32 that can function as an anti-binding feature to reduce tension in the rear panel 22 during opening and closing of cover portion 14. Slot 32 can have any suitable orientation and configuration and can be linear, curved, uninterrupted, segmented or any other desired formation.

As shown in FIGS. 2-7, tray portion 12 can include end flaps 34 connected to each side edge of the front and rear panels 20 and 22 and configured to secure front and rear panels 20 and 22 to side panels 18 and enable tray portion 12 (and container 10 overall) to transition between the folded-flattened position (see FIGS. 8 and 9) and the use position (see FIGS. 1 and 3-7) as described in greater detail below. End flaps 34 can be foldably connected to the side edges of front and rear panels 20 and 22 by a fold line and extend laterally outward from the side edges of front and rear panels 20 and 22 to provide end flaps 34 with a terminal free lateral edge 34*a* and a terminal free lower edge 34*b*. When container 10 is formed from blank 100, the end flaps 34 can be folded away from front and rear panels 20 and 22 toward side panels 18 so that end flaps 34 overlie side panels 18 along the interior of tray portion 12, as best depicted in FIGS. 3 and 4.

As further shown in FIGS. 2-4, cover portion 14 can include end flaps 36 connected to each side edge of the front panel 28 and configured to secure front panel 28 to side panels 26 and enable cover portion 14 (and container 10 overall) to transition between the folded-flattened position and the use position. Each cover end flap 36 can be foldably connected to the side edges of front panel 28 by a fold line and extend laterally outward from the side edges of front panel 28, similar to tray end flaps 34. In addition, end flaps 36 can include a terminal free lower edge 36*b*.

When container 10 is formed from a blank 100, end flaps 36 can also be folded away from front panel 28 and toward side panels 26 so that end flaps 36 overlie side panels 26 along the interior of cover portion 12. According to one embodiment, the terminal free lower edges 34*b* and 36*b* of each end flap 34 and 36 can have a slightly outward angled orientation which can assist in creating frictional, interfering, and/or engaging fit with said bottom panel 16 (for end flaps 34) and said top panel 24 (for end flaps 36). The outward angled configuration of lower edges 34*b* and 36*b* can assist front panel 20, rear panel 22, and side panels 18 of tray portion 12, and front panel 28 and side panels 26 of cover portion 14, to remain in an upright orientation when container 10 is unfolded into the use position.

As best shown in FIGS. 2 and 4, side panels 18 of tray portion 12 can include triangular fold flaps 38 positioned along both sides of each side panel 18. Triangular fold flaps 38 can be formed by a diagonal fold line 38*a* extending in a general inward angled direction from the fold edge of side panel 18 (connecting side panel 18 to bottom panel 16) to the free edge of side panel 18 opposite the fold edge. As further shown in FIGS. 2 and 4, side panels 26 of cover portion 14 can include similar triangular fold flaps 40 positioned along the sides of side panels 26 adjacent to front panel 28 of cover portion 14. Triangular fold flaps 40 can be formed by a diagonal fold line 40*a* extending in an angled direction from the fold edge of side panels 26 to the free edge of side panels 26 opposite the fold edge.

As best shown in FIG. 3-7, when container 10 is formed from blank 100, end flaps 34 of tray portion 12 can be partially or fully secured to triangular fold flaps 38 along the interior of tray portion 12 using an adhesive, heat sealing or other suitable attachment means. Similarly, as shown in FIGS. 3-7, end flaps 36 of cover portion 14 can be partially or fully secured to triangular fold flaps 40 along the interior of cover portion 14. As shown, each end flap 34 and 36 can be secured to its corresponding triangular fold flap 38 or 40 so that only the portion of end flaps 34 and 36 overlying the triangular fold flaps 38 and 40 are secured to triangular fold flaps 38 and 40 and the remaining portion of end flaps 34 and 36 overlying the portion of side panels 18 and 26 below the diagonal fold line 38*a* and 40*a* forming the triangular fold flaps 38 and 40 are not secured to side panels 18 and 26. Such a configuration can enable container 10 to transition between the folded-flattened position and the use position as described in greater detail below.

As best shown in FIGS. 1-7, rear panel 22 of tray portion 12 can have a height greater than the height of the side panels 18 and front panel 20 of tray portion 12. According to one embodiment, the height of rear panel 22 can be approximately equal to the combined heights of side panels 18 of tray portion 12 and side panels 26 of cover portion 14 so that when container 10 is in a closed position, side panels 18 and 26 combine to form a generally enclosed sidewall along the entire height of container 10. It is also recognized that in alternative embodiments, side panels 18 and 26 can combine to have a height greater than rear panel 22 so that side panels 18 and 26 have a partially overlapping configuration when container 10 is in the closed position.

As further shown in FIGS. 1-7, front panel 28 of cover portion 14 can have a height slightly greater than the height of side panels 26 of cover portion 14 to enable front panel 28 of cover portion 14 to partially overlap front panel 20 of tray portion 12 when container 10 is in a closed position. As further shown in FIGS. 2, 3 and 7, front panel 28 of cover portion 14 can include a locking means 42 in the form of a notch or protrusion that can correspond to a joining locking means 44 on front panel 20 of tray portion 12 in the form of a slot or opening. As best shown in FIG. 7, when container 10 is in the closed position and front panel 28 of cover portion 14 is partially overlapping front panel 20 of tray portion 12, the locking means 42 on front panel 28 can insert through the locking means 44 on front panel 20 in order to secure container 10 in the closed configuration. Container 10 can then be placed in the open position by moving the locking means 42 inward and enabling cover portion 14 to be rotated away from tray portion 12 about hinge line 30.

As further shown in FIGS. 1-6, and particularly FIGS. 4 and 6, side panels 26 of cover portion 14 can optionally include an outer terminal edge 46 having a first curved edge profile portion 48 extending from hinge line 30 and a second edge portion 50 extending the remainder of the length of outer terminal edge 46. As shown in FIGS. 1-6, first curved edge profile portion 48 can extend only a portion of the length of outer terminal edge 46 and second edge portion 50 can have a straight or linear shape. Second edge portion 50 can alternatively have any other desirable shape or configuration.

Similarly, end flaps 34 connected to rear panel 22 of tray portion 12 can optionally include an outer terminal edge 52 with a first curved edge profile portion 54 extending from hinge line 30. As shown in FIGS. 1-6, curved edge profile portion 54 may extend the entire length of outer terminal edge 52, from hinge line 30 to a lateral edge 56. In other embodiments (not shown), curved edge profile portion 54 can also extend only a portion of the length of outer terminal edge 52 of end flaps 34 and outer terminal edge 52 can have a second edge portion with a straight or linear shape generally corresponding to the outer edge of adjacent side panels 18. This second edge portion can alternatively have any other desirable shape or configuration.

As best shown in FIGS. 5 and 6, curved edge profile portion 54 of end flaps 34 may generally conform to curved edge profile portion 48 of side panels 26 so that when container 10 is in the closed position, the conforming configuration of curved edge profile portion 48 (of cover side panels 26) and curved edge profile portion 54 (of tray end flaps 34) enclose the sides of container 10. The inclusion of curved edge profile portions 48 and 54 can provide greater stability to rear panel 22 and container 10 overall and facilitate the opening and closing of cover portion 14 relative to tray portion 12 when container 10 is transitioned between the open and closed positions. It will be appreciated that the curved edge profile portions 48 and 54 may each have a contour different from that shown in the figures, as such contour is not necessarily crucial to the function of the container 10, and they may be of any suitable size, shape, contour and orientation.

Figure 8:
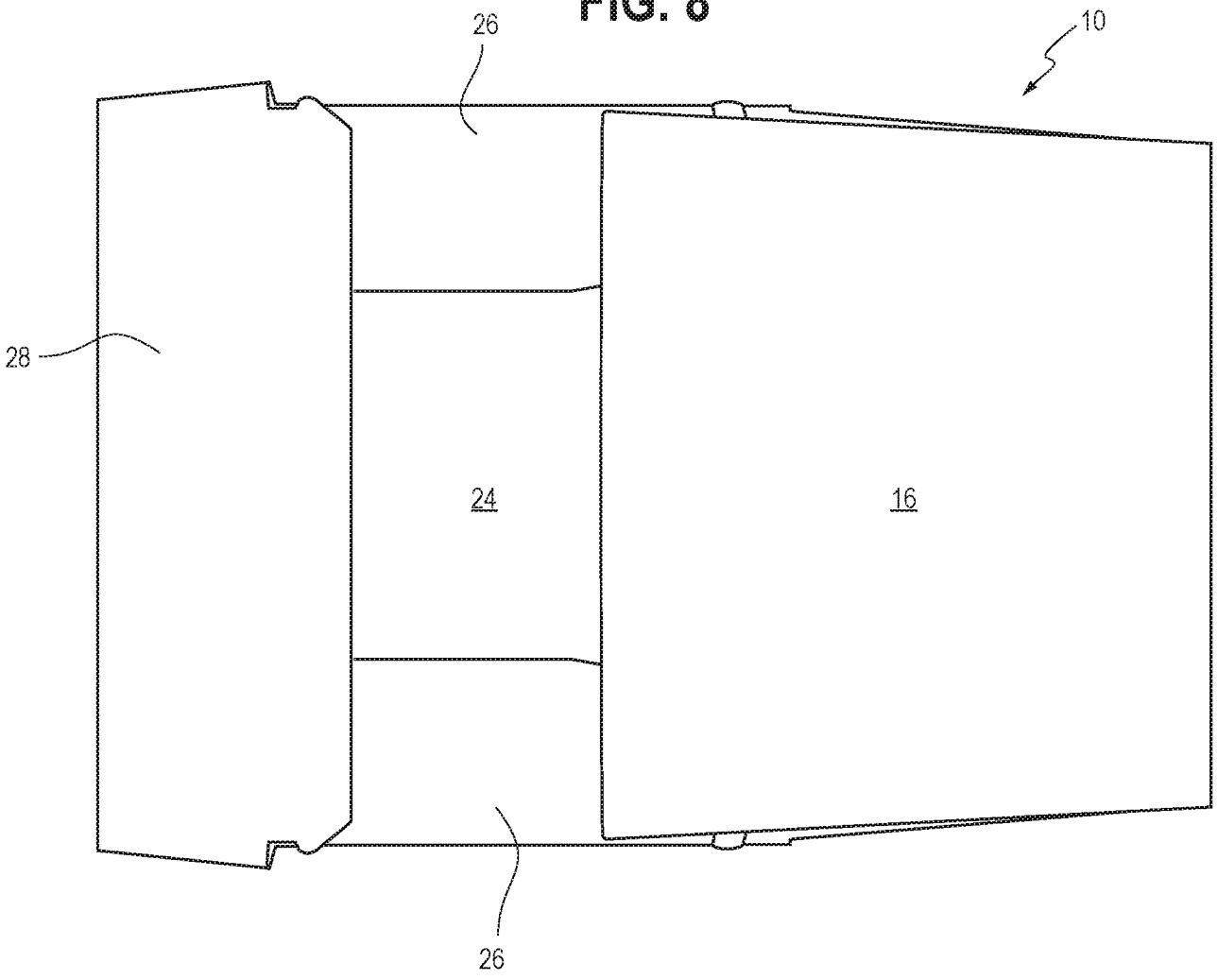
FIG. 8 is a top perspective view of the foldable container of FIG. 1, illustrating the foldable container in a folded-flattened position in accordance with one embodiment of the present invention.
Figure 9:
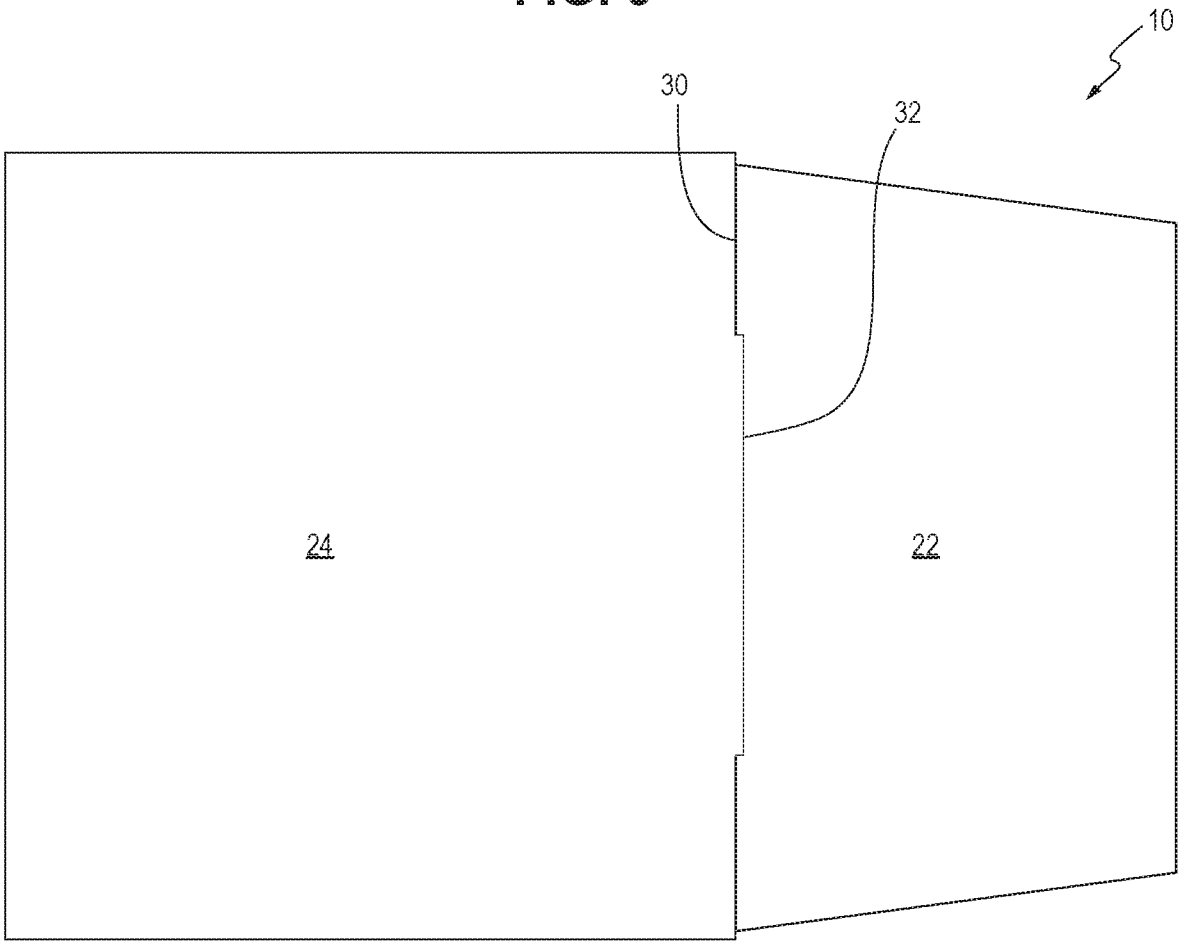
FIG. 9 is a bottom perspective view of the foldable container of FIG. 1, illustrating the foldable container in a folded-flattened position in accordance with one embodiment of the present invention.

Turning now to FIGS. 8 and 9, container 10 is shown in its folded-flattened position where panels 18-22 of tray portion 12 have been folded against bottom panel 16 and panels 26 and 28 of cover portion 14 have been folded against top panel 24. When container 10 is formed from blank 100, each side panel 18 of tray portion 12 can be folded inward in parallel relationship overlying bottom panel 16 and each triangular fold flap 38 on each side panel 18 can then be folded over onto the side panel 18. Then, each end flap 34 on tray portion 12 can be folded inward against the interior surface of its respective front panel 20 or rear panel 22 and the front and rear panels 20 and 22 can be folded downward and the end flaps 34 can be partially or fully secured to the triangular fold flap 38 it overlies using an adhesive or other securing means. The same procedure can be applied to the panels of cover portion 14 where side panels 26 are folded inward, triangular fold flaps 40 are folded over and end flaps 36 of folded and secured to the triangular fold flaps 40. This formation can result in the folded-flattened position of container 10 as best illustrated in FIGS. 8-9.

Figure 10:
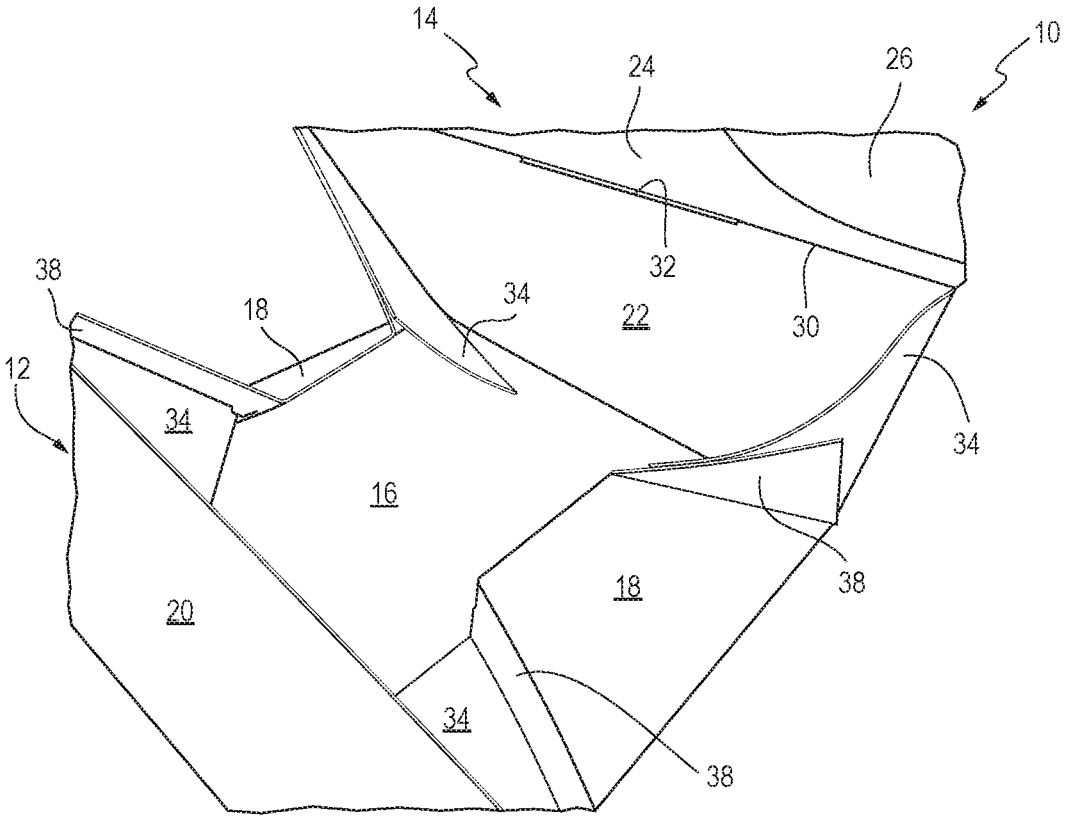
FIG. 10 is a partial perspective view of the foldable container of FIG. 1, illustrating the foldable container transitioning between an open-configured position and a folded-flattened position in accordance with one embodiment of the present invention.

FIG. 10 illustrates container 10 transitioning from the folded-flattened position (as illustrated in FIGS. 8 and 9 to the configured position (as illustrated in FIGS. 3-4). As shown, front panel 20 and rear panel 22 of tray portion 12 can be pulled away from bottom panel 16, which will simultaneously cause side panels 18 to also pull away from bottom panel 16 due to the connection between end panels 34 and triangular fold flaps 38 until front panel 20, rear panel 22 and side panels 18 are all in a generally perpendicular position relative to bottom panel 16. As further shown in FIGS. 6 and 7, panels 20-22 can each additionally have a slightly outwardly-tapered orientation after being rotated away from bottom panel 16, which can facilitate the nesting of multiple configured containers 10. Once panels 18-22 are in a raised position, the frictional force between the lower end of end flaps 34 and bottom panel 16 can act to maintain the raised position of panels 18-22 and provide structural strength for the panels 18.

The end flaps 34 may optionally be sized to create an interference fit or near interference fit in order to create an increased amount of friction with the bottom panel 16. According to such an embodiment, as best shown in FIGS. 3 and 4, the lower edge of end flaps 34 can engage with bottom panel 16 and create an interference fit between end flaps 34 and bottom panel 16, which can assist in maintaining container 10 in is configured position and increase the strength and rigidity of container 10. While not shown in FIG. 10, the same procedure described above can be performed on cover portion 14 by raising front panel 28 away from away from top panel 24, which in turn causes side panels 26 to lift away from top panel 24 due to the connection between end flaps 36 and triangular fold flaps 40. End flaps 36 can also be configured to create and interference fit or near interference fit with top panel 24, which can result in increased strength and rigidity of cover portion 14. In addition, as best illustrated in FIG. 7, according to one embodiment, side panels 26 can be configured to maintain a substantially perpendicular configuration relative to top panel 24 without an outwardly-tapered orientation.

In certain embodiments of the present invention, the foldable sidewall configuration of container 10 with end flaps 34 and 36 and triangular fold flaps 38 and 40 can also be configured in accordance with the design of the tray container disclosed U.S. patent Publication Ser. No. 15/806,207 (published as U.S. Patent Publication No. 2018/0127151), entitled "Tapered-Wall Four Corner Tray", the entire disclosure of which is incorporated herein by reference.

Once all panels 18-20 and 26-28 have been raised away from bottom panel 16 and top panel 24, respectively, then container 10 is placed into its configured position and ready for use. Container 10 can also be placed back into its folded-flattened position by pushing end flaps 34 of tray portion 12 toward the front and rear panels 20 and 22 until they no longer contact bottom panel 16 and are free to fold under the front and rear panels 20 and 22 and allow side panels 18 to collapse. Similarly, the end flaps 36 of cover portion 14 can be pushed inward until side panels 26 are able to collapse against top panel 24.

As described above, once container 10 is placed into its configured position, it can be transitioned between an open position (see FIGS. 3-4) and a closed position (see FIGS. 5-7) by rotating cover portion 14 relative to tray portion 12 about hinge line 30. As further shown in FIG. 5, when container 10 is placed into the configured-closed position, a portion of front panel 28 of cover portion 10 can contact and rest upon the end flaps 34 of tray portion 12, which can provide increased stability to container 10 in the configured-closed position.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A container comprising:

a tray portion comprising:

a bottom panel;

a front panel extending from a front edge of said bottom panel;

a rear panel extending from a rear edge of said bottom panel opposite said front edge, said rear panel having a rear panel height;

a tray side panel extending from a tray side edge of said bottom panel and positioned between said front and rear panels, said tray side panel have a tray side panel height;

a rear end flap extending from an end edge of said rear panel, said rear end flap folded relative to said rear panel and secured to said side panel; and a cover portion comprising:

a cover panel extending from an upper edge of said rear panel; and a cover side panel extending from a cover side edge of said cover panel said cover side panel having a cover side panel height;

wherein said cover portion is rotatable relative to said tray portion by means of a hinge line to formed along said upper edge of said rear panel to enable said foldable container to transition between open and closed positions;

wherein said rear panel height is greater than each of said tray side panel height and said cover side panel height;

wherein said rear end flap includes an end flap terminal edge with a first curved edge profile portion;

wherein said first curved edge profile portion extends from said upper edge of said rear panel to a lateral edge of said rear end flap, wherein said first curved edge profile portion adjacent to said rear panel is generally aligned with said upper edge of said tray side panel and said first curved edge profile portion adjacent said lateral edge of said rear end flap is generally aligned with an upper edge of said tray side panel; and wherein said first curved edge portion extends above said tray side panel height.

2. The container of claim 1, wherein said rear panel height is approximately equal to the sum of said tray side panel height and said cover side panel height.

3. The container of claim 1, wherein said front panel has a front panel height, and wherein said rear panel height is greater than said front panel height.

4. The container of claim 1, wherein said cover side panel includes a cover side panel terminal edge having a first curved edge profile portion.

5. The container of claim 4, wherein said first curved edge profile portion of said cover side panel generally conforms to said first curved edge profile portion of said end flap of said tray portion.

6. The container of claim 1, wherein said tray side panel includes a triangular fold flap formed therein on each end of said tray side panel adjacent said front and rear panels, wherein each triangular fold flap is foldable against a remainder of said side panel, and wherein said front panel includes front end flap extending from an end edge of said front panel, said front end flap folded relative to said front panel and secured to said side panel.

7. The container of claim 6, wherein said front and rear end flaps are each secured to one of said triangular fold flaps of said tray side panel.

8. The container of claim 7, wherein said container is configured for transitioning between a folded-flattened position and a configured position, wherein said front panel, said rear panel and said tray side panel are each folded flat against said bottom panel when said container is in said folded-flatted position, and wherein said front panel, said rear panel and said tray side panel are each generally perpendicular and slightly tapered relative to said bottom panel when said foldable container is in said configured position.

9. The container of claim 8, wherein said triangular fold flaps connected to said front panel overlie said remainder of said side panel and said front and rear end flaps at least partially overlap said triangular fold flaps when said container is in said folded-flattened configuration.

10. The container of claim 8, wherein said front end flap and said rear end flap each include a lower edge, and wherein said lower edges create an interference fit with said bottom panel when said container is in said configured position.

11. The container of claim 10, wherein said front end flap and said rear end flap each frictionally engage said bottom panel and assist in maintaining said front and said rear panels and said side panel in a generally perpendicular relationship with respect to said bottom panel.

12. The container of claim 1, further comprising a first locking means provided on said cover portion and a second locking means provided on said tray portion, said first and said second locking means configured for securing said container in said closed position.

* * * * *